United States Patent [19]

Collet

[11] 4,028,974

[45] June 14, 1977

[54] APPARATUS FOR CUTTING BITUMEN CAKES

[76] Inventor: Jean-Jacques Collet, 760 Chemin de Cleres, 76230 Bois Guillaume, France

[22] Filed: Dec. 30, 1974

[21] Appl. No.: 537,338

[30] Foreign Application Priority Data

Jan. 16, 1974 France ..... 74.01446
Nov. 29, 1974 France ..... 74.38032

[52] U.S. Cl. ..... 83/171; 83/255; 83/408; 83/928; 264/160

[51] Int. Cl.[2] ..... B26D 7/10

[58] Field of Search ..... 83/39, 14, 27, 34, 35, 83/42, 162, 112, 125, 203, 204, 437, 925 R, 44, 171, 255, 408, 928; 264/160, 157

[56] References Cited

UNITED STATES PATENTS 2,373,593 4/1945 Pease ..... 264/157
2,858,569 11/1958 Dupuy ..... 264/160

*Primary Examiner*—Othell M. Simpson
*Assistant Examiner*—W. D. Bray

[57] ABSTRACT

This invention provides an improved method and an improved apparatus for cutting bitumen cakes or like products from a sheet of the product previously cast in a flat-bottomed basin, during the cooling of the sheet. The cakes are cut out of strips previously cut out of said sheet. A transverse girder mounted on wheels span the basin, and suspended from the girder is a carriage supporting a pivoted heated cutter. As the cutter moves in the cutting direction it cuts a transverse strip of product and carries along a trolley provided with a wedge member adapted at the same time to raise the cut strip. The carriage also comprises a pusher arm whereby, during the return stroke of said carriage, said pusher arm can drive the fully cut strip towards another cutter of the guillotine type which cuts the cakes out of the strip. During the strip cutting step, the carriage also carries along a belt so as to insert the same under the strip as it is cut by said first cutter.

10 Claims, 15 Drawing Figures

1
1a
2
3
4
5
6
7
8
9
10
11
14
15
24
31
32
43
44
45
46
51
52
53
54
55
56
56a
57
64
65

VI
VI
VII
VII
1
1a
2
3
4
5
6
7
8
9
10
11
14
24
31
32
43
44
45
46
51
52
53
54
55
56
56a
64
65

55
6
55
54
2
10
14
24
3
45
VI
VI
48
44
48a
46
VII
VII
66
57
60
61
4
4
5
46
56
58
60
61
62
63
46
48a
52
59
51
48
10
14
46
48b
46
54
48a
50
48a
48b
49

X
X

XIII
XIII
X
X

APPARATUS FOR CUTTING BITUMEN CAKES

BACKGROUND OF THE INVENTION

Various methods and means have already been proposed for cutting bitumen cakes out of a bitumen sheet during the cooling thereof in a basin, said sheet having previously been cast into the bottom of said basin. Now the present invention is concerned with a method intended for this specific purpose but using an apparatus simpler and more reliable than the apparatus known heretofore in the art of cutting bitumen cakes, this apparatus comprising inter alia a considerably lighter mechanism affording a substantial reduction in the power required for its operation.

SUMMARY OF THE INVENTION

To this end, the method according to this invention for cutting bitumen cakes or other similar products out of a sheet of said product during the cooling thereof in a basin into which it was previously cast, which comprises the steps of raising and separating from said sheet a transverse strip thereof, by means of a transverse cut, and subsequently moving said cut strip transversely while cutting same during this movement into cakes of like dimensions, removing said cakes and subsequently performing the same sequence of steps with the next transverse strips until the complete sheet has been cut into cakes, is characterised in that a strip of the product which has a width equal to the length of the cakes to be obtained is cut out of one longitudinal end of the sheet; that the strip section being cut is raised as it is cut until the complete strip has been raised, and at the same time one run of an endless conveyor belt stretched between two transversely movable rollers and of a width greater than that of said strip is unrolled under the strip being cut; that the strip section is deposited on to said belt run as said strip is cut and raised while avoiding any relative movement between the strip and the belt; then, by means of a step by step transverse movement, the belt run and the strip of product supported thereby are moved in the opposite direction, the length of each step of this movement corresponding to the width of the cake to be cut; during each pause of the belt and of the strip of product carried thereby, one cake of product is cut out of the front end of the strip product, and the cakes thus obtained are removed as they are cut, and, when the complete strip of product has been cut into cakes, the same sequence of steps are repeated with another transverse strip of product, and so forth.

The apparatus for carrying out the method of this invention is characterised in that it comprises in combination a flatbottomed basin in which a sheet of bitumen or other product to be cut into cakes is adapted to be cast, a transverse substantially horizontal girder spanning said basin, wheels for supporting and guiding the two ends of said girder on longitudinal races disposed on either side of the basin, means for feeding said girder step by step on said wheels, a carriage suspended from said girder, means for causing said carriage to travel under said girder with a steady motion in one direction corresponding to the cutting of one transverse strip of product, and with a step by step motion in the opposite direction corresponding to the removal of the strip of cut product, a heated cutter suspended from said carriage, means for lowering said heated cutter to an operative position and cause same to cut a transverse strip out of said sheet of product when said carriage travels in said one direction, and raising said cutter and holding same in an inoperative position when said carriage travels in said opposite direction, a pusher arm carried by said carriage and provided with an operative end adapted to slide on the strip of product during the cutting operation, when said carriage travels in said one direction, and to push in front of it the end of the strip of product which has just been cut when said carriage travels in said opposite direction, a wedge member pulled by said carriage and adapted to roll transversely on the bottom of said basin for raising said strip of product as it is cut, a transverse belt section adapted to carry and discharge transversely the transverse strip of product cut out of said sheet, means for unrolling one run of said belt section under said strip of product, behind said wedge member, as said strip is being cut, in order to avoid any relative movement between said belt section and said product, means for returning in said opposite direction said belt with said wedge member and the completely cut strip of product supported by said belt while avoiding any relative movement between said belt and said product, and a longitudinal cutter adapted to cut a cake of product from said strip of product each time said belt is stopped during said return movement.

BRIEF DESCRIPTION OF THE DRAWINGS

Other features and advantages of the method and apparatus of the present invention will appear as the following description proceeds with reference to the attached drawings illustrating diagrammatically by way of example two specific and preferred forms of embodiment of the invention. In the drawings.

DESCRIPTION OF THE PREFERRED EMBODIMENT

Figure 1:
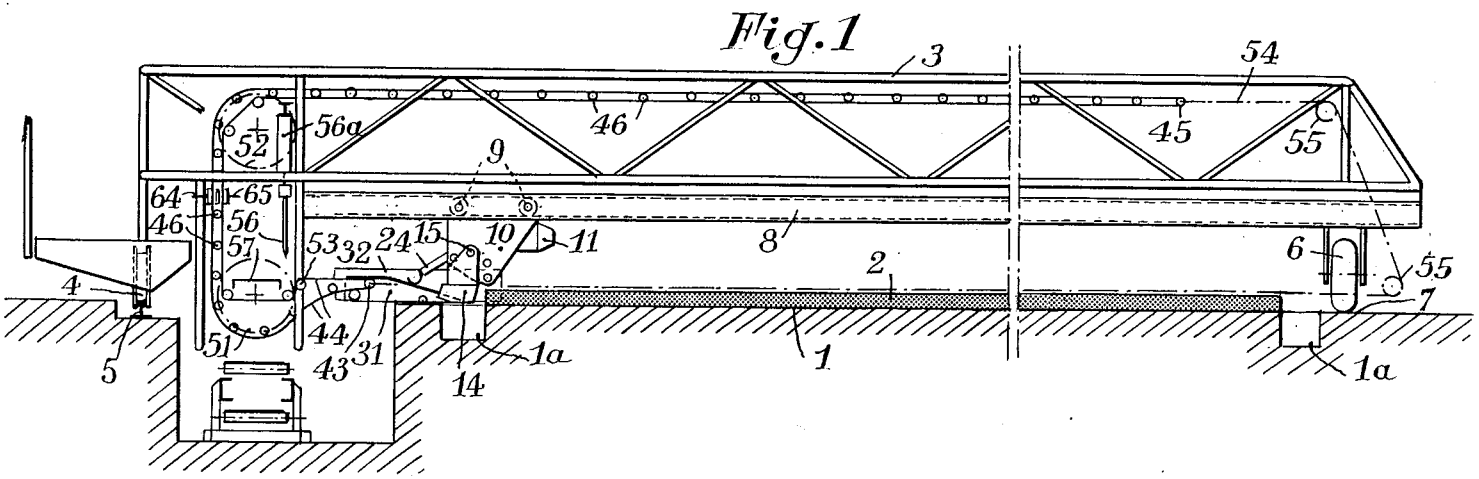
FIGS. 1 to 4 are cross-sectional views of a first form of embodiment of the apparatus, illustrating in front view the transverse girder spanning the basin, with the cutter-supporting carriage suspended from said girder in the various positions assumed by said carriage during the operation of the apparatus.

In the various Figures of the drawings the same reference numerals are used throughout for designating the same component elements in both forms of embodiment which differ essentially in that in the first form of embodiment the belt stretched between two transversally movable rollers and of a length greater than that of the strip of product to be cut consists of an endless belt section utilizing these stretching rollers as return rollers, whereas in the second form of embodiment said belt section consists of a series of parallel rollers disposed at spaced intervals between these two stretching rollers, with a distance between centers of adjacent rollers small enough to prevent the transverse strip of bitumen cut out and deposited thereon from detrimentally sagging in the gaps left between adjacent rollers.

The apparatus illustrated in FIGS. 1 to 13 of the drawings comprises essentially a basin having a bottom 1 on which a sheet 2 of a product such as bitumen or asphalt is cast and adapted to be cut out into rectangular cakes during the cooling of said product.

Spanning this basin is a substantially horizontal girder 3 supported at one end by metal-rimmed wheels 4 running on a longitudinal rail 5, and at the other end by pneumatic-tyred wheels 6 rolling on a race 7.

In a pair of longitudinal U-sectioned and registering beams 8 of the girder structure 3 a plurality of wheels 9 are adapted to roll. Suspended from these wheels is a carriage 10 incorporating a motor rotatably driving pinions 12 (FIG. 8) in constant meshing engagement with toothed racks 13 secured to the underface of the lower wings of said beams 8. A heated cutter 14 is suspended from said carriage 10 and adapted to pivot about a shaft 15 mounted in said carriage. A spring 16 has one end attached to one end of a lever 17 and the other end anchored to a fixed location of carriage 10, so as to constantly urge the cutter 14 to its inoperative position, this movement being permitted however only when a retractable stop member 18, engaged by the mounting 19 of cutter 14 during the cutting operation, is retracted.

Figure 3:
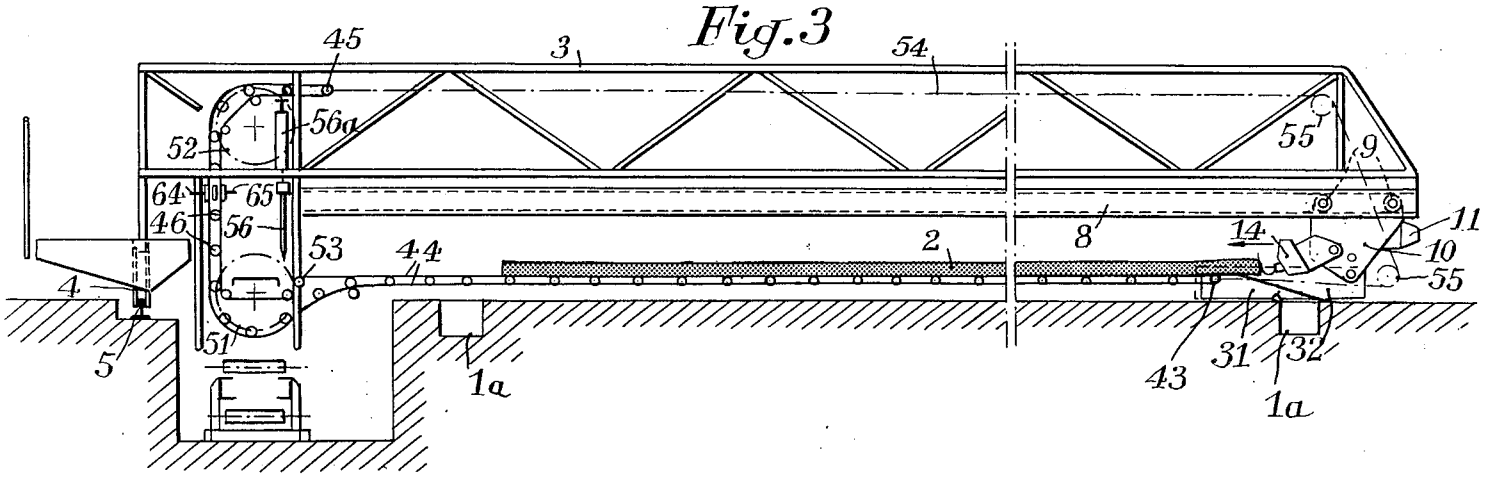
Figure 4:
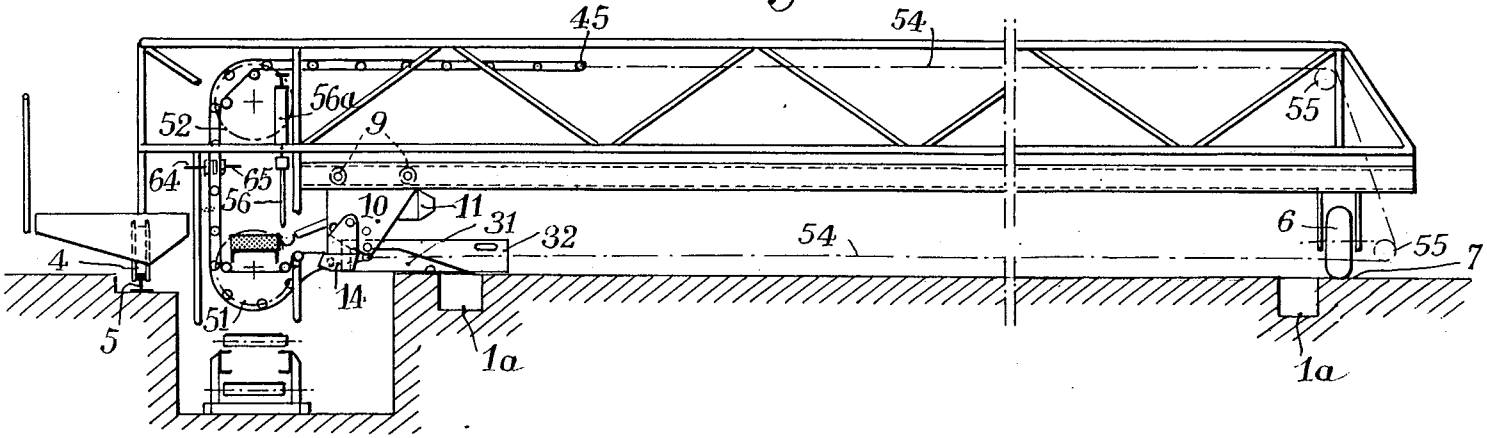
Figures 5, 6, 7:
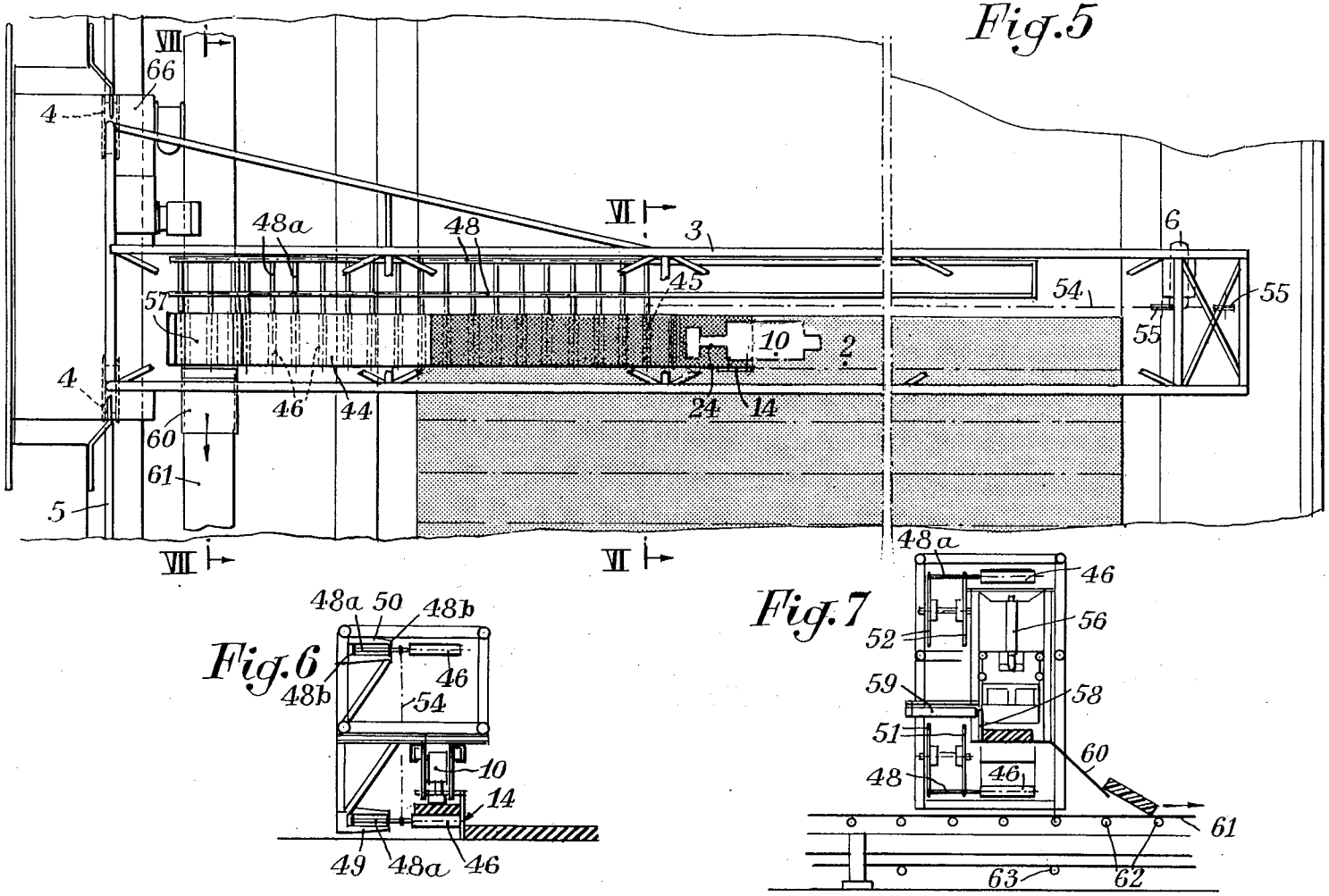
FIG. 5 is a plane view corresponding to FIG. 2, in which it is assumed that the upper portion of the transverse girder has been cut to show the transverse strip of product during the cutting operation.
FIG. 6 is a fragmentary section taken along the line VI—VI of FIGS. 2 and 5.
FIG. 7 is a fragmentary section taken along the line VII—VII of FIGS. 2 and 5.
Figure 8:
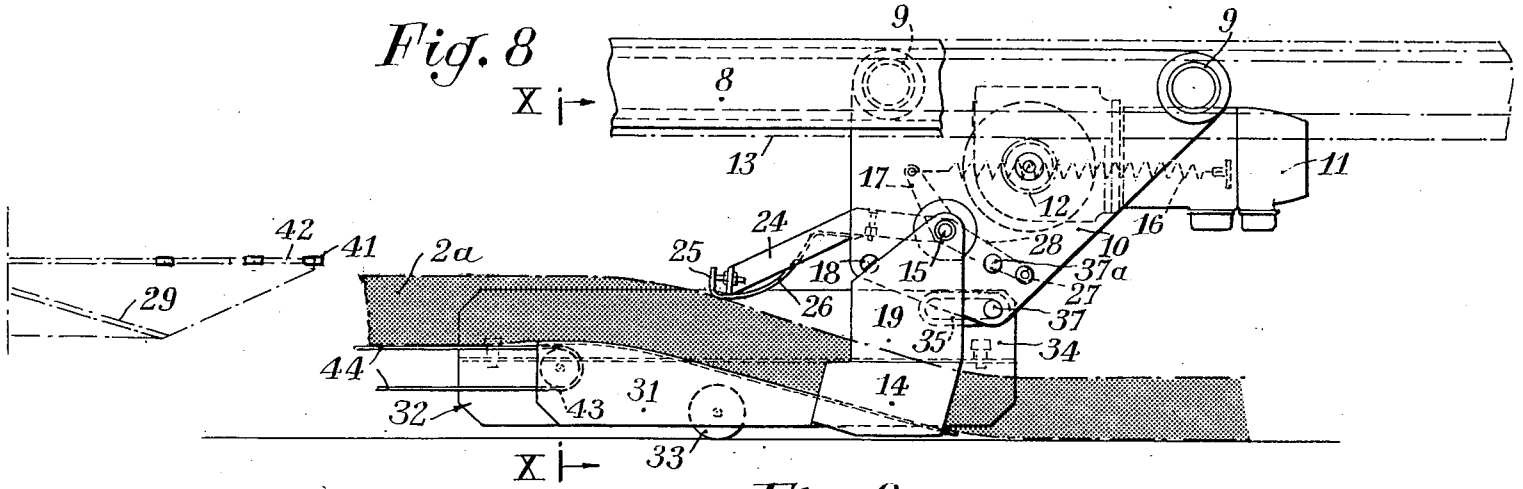
FIG. 8 is a fragmentary elevational view showing on a larger scale the suspended carriage during the cutting of a transverse strip out of a sheet of product.
Figure 9:
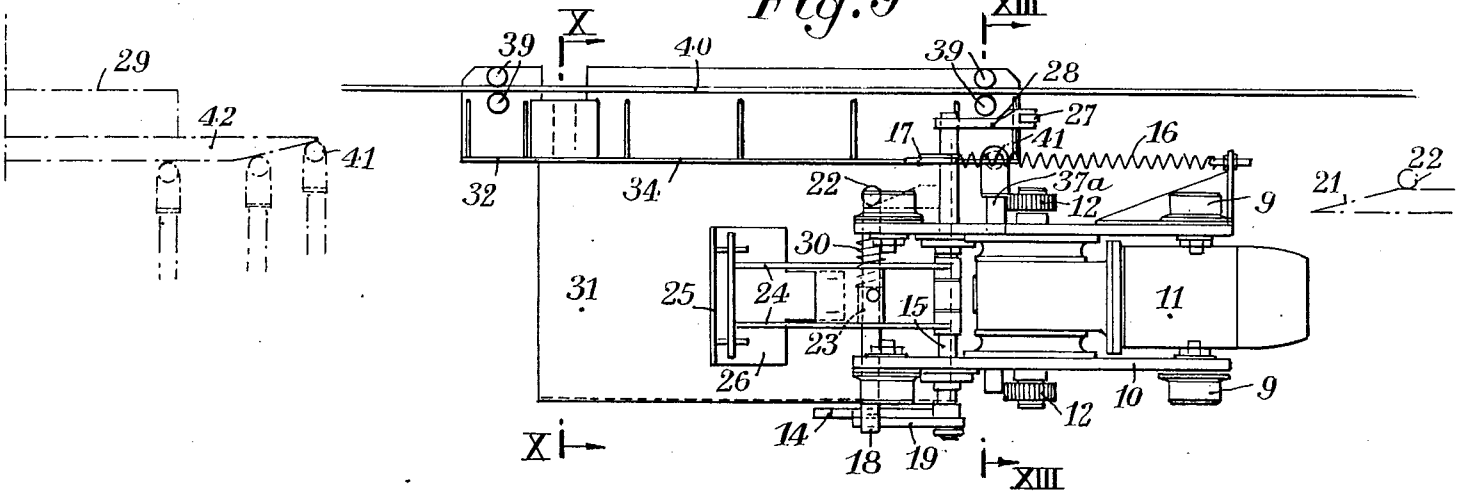
FIG. 9 is a corresponding plane view from which the strip of product has been removed.
Figure 10:
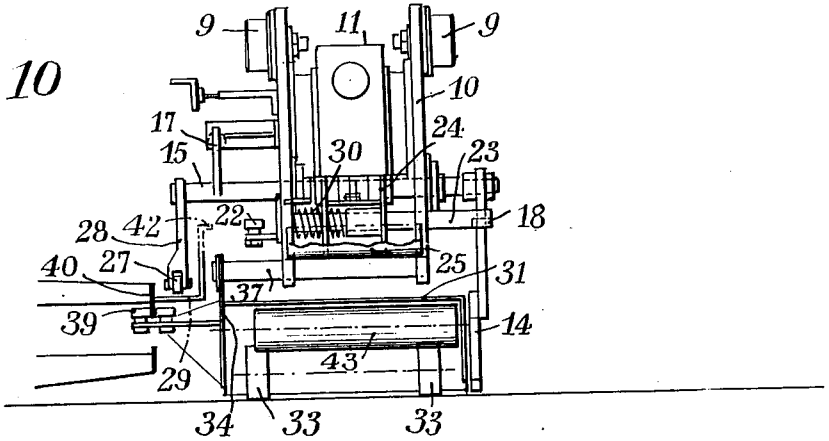
FIG. 10 is a section taken along the line X—X of FIGS. 8 and 9, without the transverse strip of product.
Figure 11:
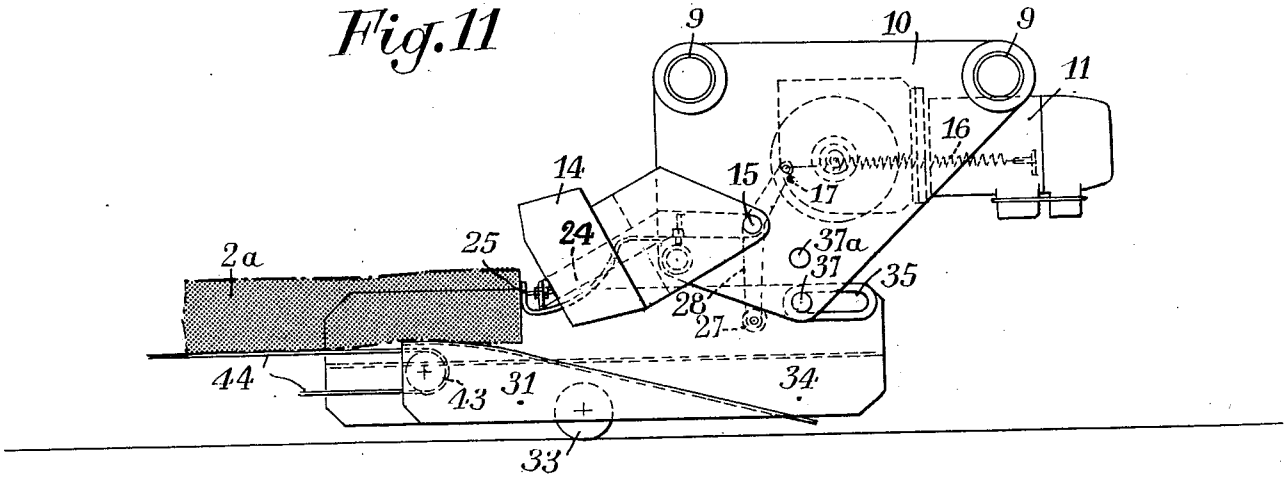
FIG. 11 is a view similar to FIG. 8 showing the removal of the cut strip of product.
Figure 12:
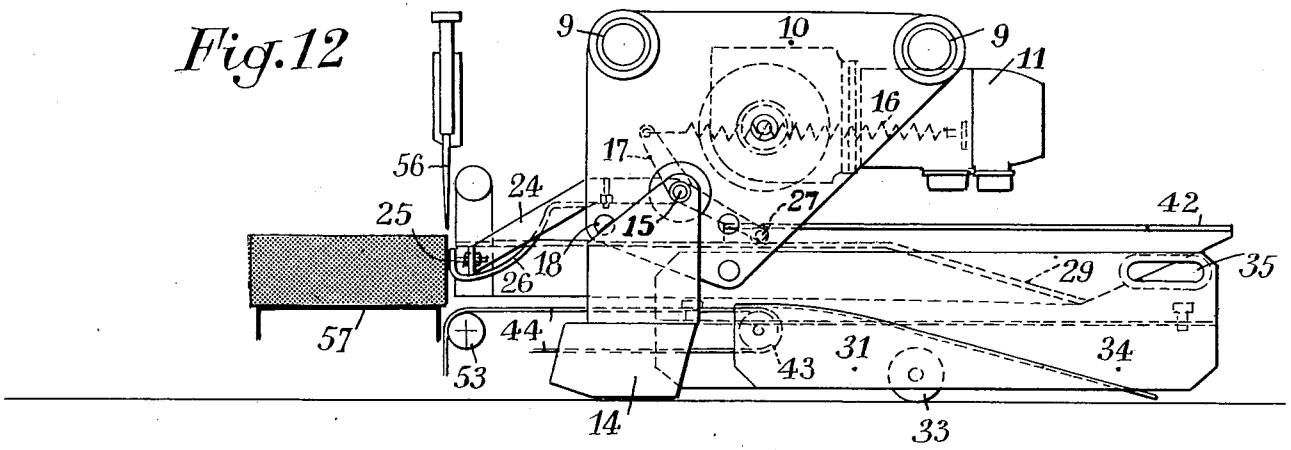
FIG. 12 is a view similar to FIG. 8 and 11, showing the position of various component elements of the apparatus at the end of the return stroke of the carriage, after the complete removal of the strip of product and the cutting thereof into cakes.
Figure 13:
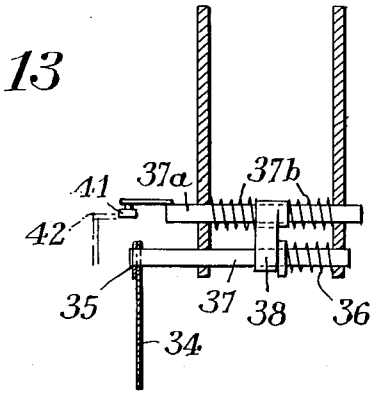
FIG. 13 is a fragmentary section taken along the line XIII—XIII of FIG. 9, showing the device for engaging and disengaging the coupling between the suspended carriage and the wedge member.

When the carriage 10 has nearly completed its forward stroke, and a transverse strip 2*a* of the product has been cut completely out of the sheet 2, a wedge-shaped or inclined-plane member 21 engages a stud 22 rigid with one end of a rod 23 of which the opposite end constitutes the aforesaid retractable stop member 18 and causes this stop member 18 to be retracted, whereby the traction spring 16 attached to said lever 17 causes the cutter 14 to pivot backwards to its inoperative position as shown in FIGS. 3 and 11. Also mounted for free rotation on a pin 15 fixed to this carriage 10 is a pusher arm 24 carrying at its operative end a push member 25. This pusher arm 24 is mounted on a runner 26 so that it can easily slip on the top surface of the sheet of product during the forward stroke of the suspended carriage 10 which is the operative stroke causing a transverse strip 2a to be cut out of the sheet 2, as shown in FIG. 8. At the end of the return stroke of said suspended carriage 10 the roller 27 carried by one end of an arm 28 keyed on shaft 15 and rotatably rigid with the cutter mounting 19 engages an inclined plane or cam face 29, so as to pivot as shown in FIG. 12 against the force exerted by spring 16. Under these conditions, another spring 30 (FIG. 9) can restore the stop member 18 to its operative position when said cutter mounting 19 has pivoted sufficiently to permit this return movement, whereafter said stop member 18 and the heated cutter 14 are held in their operative positions.

During its translation in either direction the suspended carriage 10 carries along a wedge member 31 carried by a trolley 32 mounted on wheels 33 adapted to roll on the very bottom 1 of the basin. To this end, a vertical plate 34 rigid with the trolley 32 (see FIGS. 8 and 9) has an aperture 35 formed in its front portion and this aperture 35 is adapted, due to the force of a coil compression spring 36, to be engaged by a rod 37 rigid with said carriage 10. Thus, the carriage 10, during its forward movement of translation, carries along the trolley 32 and the latter is guided by a set of rollers 39 disposed on either side of a vertical guide strip 40.

Preferably, this aperture 35 is of elongated configuration so that at the end of the forward stroke of carriage 10, when the latter is still and the cutter 14 has been disengaged by pivoting backwards, the carriage 10 starts again in the opposite direction and drives the trolley 32 supporting the wedge member 31 only after a movement of translation corresponding to the width of said elongated aperture 35, the pusher arm 24 being then in its operative position as shown in FIG. 11.

At the end of the return stroke of carriage 10 the latter must necessarily stop driving the trolley 32 before completing its stroke, in its end position shown in FIG. 12, which it could not attain if said trolley 32 had been kept in its previous relative position. To this end, a member 38 (see FIG. 13) rigid with rod 37 and with a parallel rod 37*a*, and constantly urged by coil compression springs 37*b* to an intermediate position, permits the withdrawal of rod 37 from said elongated aperture 35 when a roller follower 41 carried by said rod 37*a* engages at the end of its stroke a cam face 42 causing said roller 41 to move inwards while pushing both rods 37*a* and 37 so that the operative end of rod 37 is removed from said aperture 35.

When the carriage 10 resumes its forward movement for achieving another cutting operation in a transverse strip 2*a*, and the roller follower 41 has cleared the cam face 42, the spring 36 engaging member 38 pushes the rod 37 outwards, the end of this rod slipping on the vertical plate 34 of trolley 32 until it registers with and engages immediately the aperture 35, thus restoring the coupling between the carriage 10 and trolley 32.

Between the front return roller 43 and the rear return roller 45 and endless belt 44 is guided by a considerable number of intermediated rollers 46 held at the proper relative spacing by a twin chain 48 interconnecting axial extensions 48*a* of said rollers 46 which are each provided with a pair of bearings 48*b* guided and supported in suitable channels 49 and 50, along their rectilinear paths, and by return or guide drums 51 and 52 along their change of direction paths. Moreover, rotary rollers 53 having fixed shafts are provided for guiding and supporting the sections of the endless belt run which are not stretched by said rollers 46.

A cable 54 (see FIGS. 1 – 4) passing over return pulleys 55 rotatably mounted on said girder 3 interconnect the front and rear return rollers 43 and 45, respectively of endless belt 44.

The apparatus further comprises a guillotine cutter 56 incorporating heated means and responsive to a cylinder and piston actuator 56*a* for cutting the cakes of product out of the front portion of the strip of product 2*a* just cut out of the sheet 32, when the endless belt 44 and the pusher arm 24, during the return stroke of carriage 10, have brought the front end of said strip on top of a table 57. Immediately after a cake has been cut out, an ejector plate 58 actuated by another cylinder and piston actuator 59 causes the freshly cut cakes to slip on a inclined plane 60 and land on an endless belt conveyor 61 stretched between rollers 62 and 63, so as to be carried along and discharged thereby (see FIG. 7).

Jacks 64 and 65 (FIGS. 1 to 4) are provided for locking one the upper run, the other the lower run of the endless belt 44, the released run being allowed to unroll freely under the tractive effort exerted by the front return roller 43, or the rear return roller 45, according to the direction of travel of trolley 32; during the cutting forward movement of carriage 10, the upper run of the belt 44 is locked by jack 65, and thus fix, so as the section of transverse strip of product 2 just cut, raised, and laying thereof; during the return of the carriage in opposite direction, the lower run of the belt 44 is locked by jack 64 and its upper run may unroll freely with the transverse strip of product completely cut and laying thereof, which is thus brought back towards the guillotine cutter; thus there is never any relative movement between the belt and the transverse strip laying thereof.

A motor 66 is adapted to drive the apparatus on its wheels 4 and 6, and thus move this apparatus to any desired position and lock the same thereat.

Of course, adequate means are contemplated for synchronizing the movements of all the component elements of the apparatus and operating the same automatically according to a predetermined program.

Figure 2:
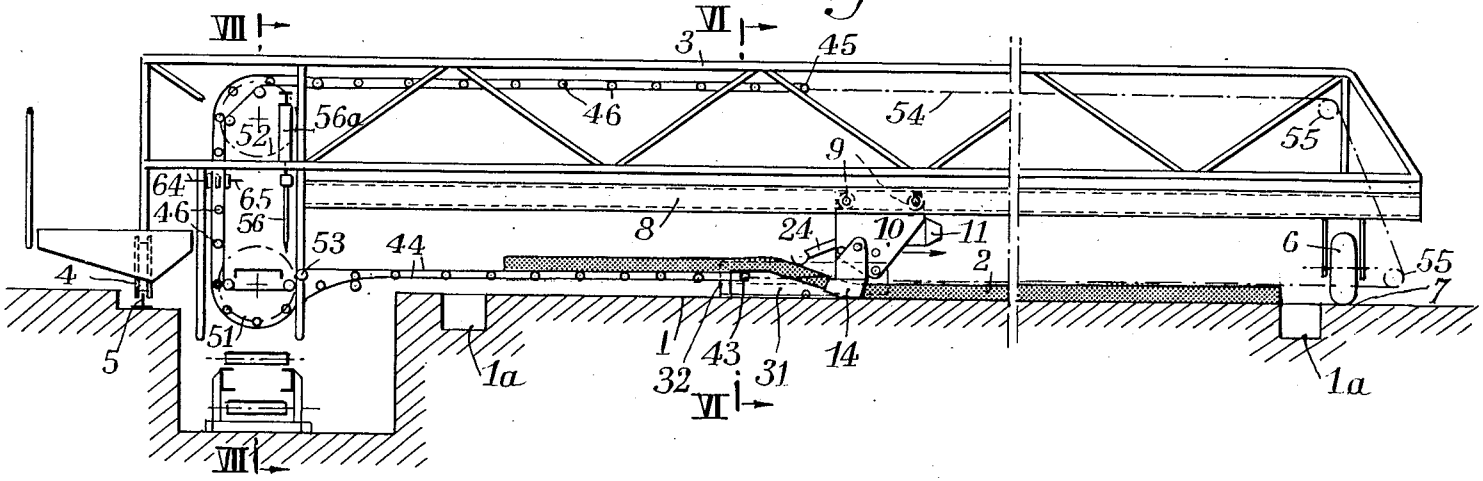

The apparatus described hereinabove operates as follows:

When a sheet of bitumen, asphalt or other product has been cut out of a sheet cast on the basin bottom, and has cooled down sufficiently to permit the easy cutting thereof, the metal walls bounding its four sides of the basin are collapsed into the corresponding channels 1a, and the girder 3 is moved in the longitudinal direction (i.e. perpendicularly to the plane of FIGS. 1 – 4) until the distance between the heated cutter 14 and the front or leading edge of the sheet corresponds to the length of the cakes to be cut out therefrom; under these conditions, the component elements of the apparatus are in the positions shown in FIG. 1. Then, the carriage 10 is driven and carries along the cutter 14, whereby the latter cuts a transverse strip of product out of the sheet while carrying along likewise the trolley 32 and the wedge member 31 so as to raise the section of transverse strip as it is cut, as shown in FIG. 2; during this operation the pusher arm 24 bears with its runner 26 on the upper surface of the strip of product being cut.

When the carriage 10 has completed its cutting stroke, as shown in FIG. 3, the stop member 18 collapses, thus enabling the cutter 14 to pivot backwards due to the force of spring 16 to the position shown in FIG. 3, the pusher arm 24 being then level or registering with the longitudinal edge of the freshly cut strip of product. During this operation, the endless bolt 44 driven by its front return pulley 43 having its shaft rigid with the wedge member 31 was unrolled under the transverse strip of product being cut out of the sheet 2, so as to be positioned on top of this strip, as clearly shown in FIG. 8, since no relative movement can take place between the upper run of belt 44 and the transverse strip of product, due to the holding of said run in its fixed position by the jack 65.

After the cutting of this transverse strip of product and the laying thereof on the endless belt 44, the strip itself must be cut into cakes of same dimensions.

To this end, the carriage 10 which, during the preceding operation, was driven continuously by its motor 11, is returned stepwise to its initial position, each step of this return movement corresponding to the width of a cake to be cut out of the strip. Besides, this step by step movement may if desired follow a continuous return movement until the front end of the strip of product cut out of the sheet has been fed sufficiently to rest on the table 57 so that a first cake can be cut. Then the carriage 10 is stopped until this first cake has been cut and allowed to slip on the inclined plane 60 so as to remove said cake and deposit same upon the endless conveyor belt 61. The movement of carriage 10, pusher arm 24 and belt run 44 supporting the strip of product is then controlled stepwise, the guillotine cutter 56 being lowered during each stop to cut another cake, until the complete strip of product has been cut into cakes of equal dimensions. However, shortly before the end of this stroke, to prevent the trolley 32 carrying the wedge member 31 and the front return pulley 43 of endless belt 44 from interfering with the movement of carriage 10, the latter is disconnected from trolley 32, as already explained in the foregoing, by means of cam 42 actuating the follower 41 and rod 37; the end of this rod 37 is thus released from aperture 35 in which it was previously engaged. Under these conditions, at the end of the stroke the mechanism is in the position illustrated in FIG. 12.

The complete apparatus is then fed on its wheels 4 and 6 through a distance equal to the length of a cake to be cut, so that the apparatus can start another cycle of operation and cut another strip of product. Then the carriage 10 is moved in the opposite direction with a continuous motion, and the rod 37 is re-introduced into the aperture 35 of vertical plate 34 of trolley 32, to permit the driving thereof at the end of the return stroke of carriage 10 in its operative position, due to the co-action of cam face 29 with roller follower 27 and stop member 18, the latter locking the carriage 10 is said operative position. Under these conditions, all the component elements are restored to their initial positions shown in FIG. 1.

Figure 14:
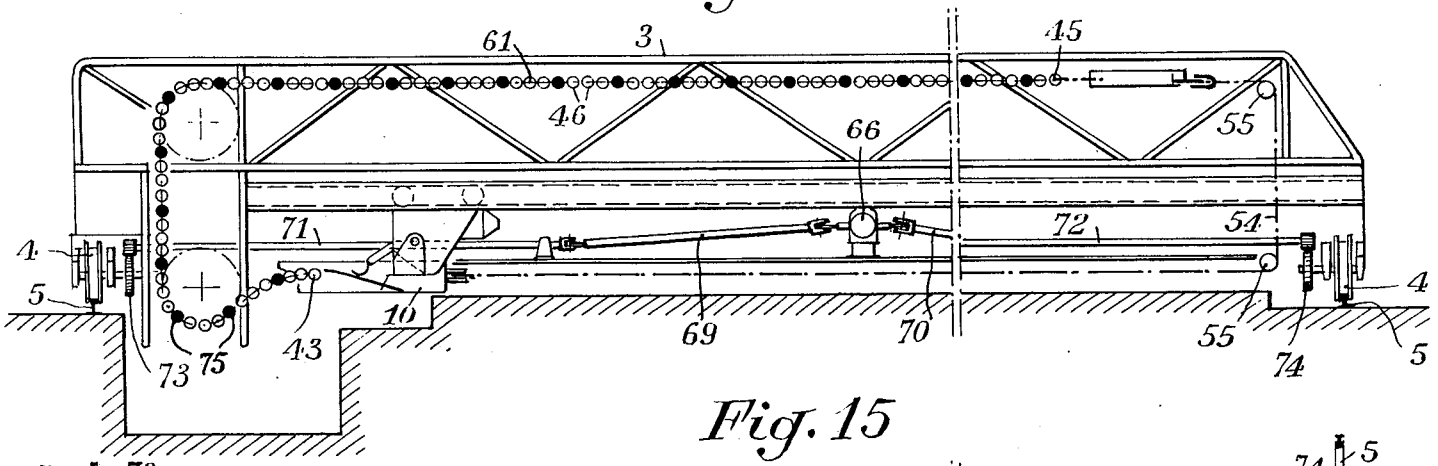
FIG. 14 is a front view showing a modified form of embodiment of this apparatus.
Figure 15:
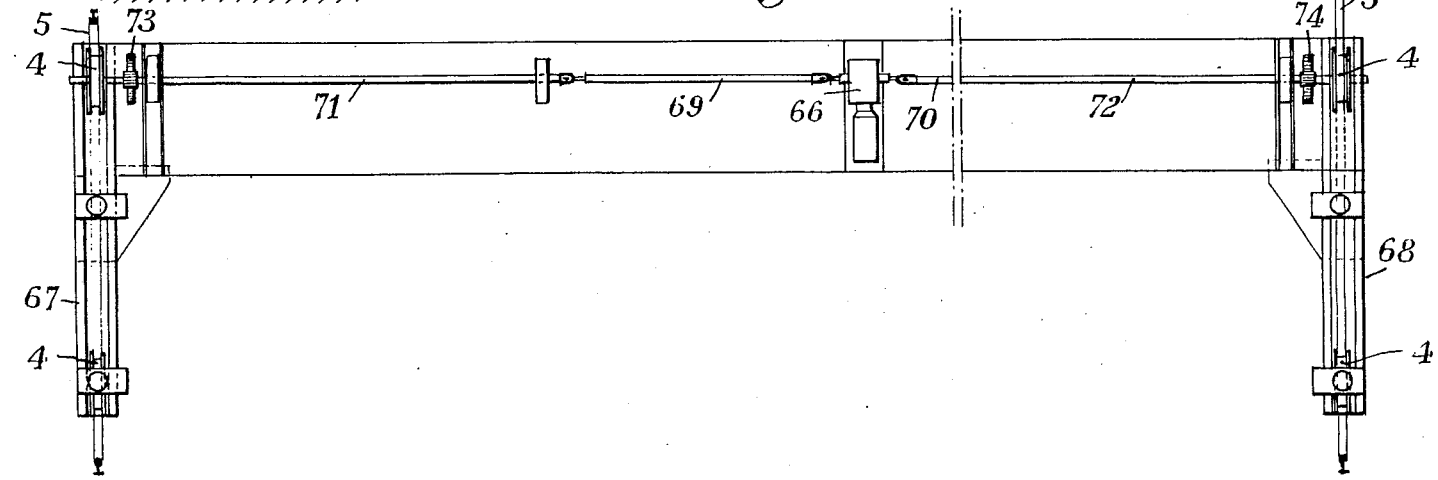
FIG. 15 is a plane view thereof.

In the modified form of embodiment illustrated in FIGS. 14 and 15, the girder 3 is supported at either end by a pair of substantially identical frame structures 67 and 68 rolling by means pairs of metal-rimmed wheels 4 on rails 5. At least one of the two wheels 4 of each frame structure is rotatably driven by means of the motor and reduction unit 66 comprising to this end two output shafts 71 and 72 driving the wheels 4 through reducing gears 73 and 74 respectively.

The endless belt 61 comprises a series of parallel and closely-spaced rollers 46 rotating freely about their axes between end rollers 43 and 45. End roller 45 is connected to carriage 10 by means of a cable 54 passing over return pulleys 55, the end roller 43 is mounted for translation bodily with carriage 10.

Some of the rollers 46 constituting the endless belt 61, for instance every four rollers, are provided with a magnetic brake device 75 adapted to lock the corresponding roller on its shaft, thus preventing any rotation thereof when the driving carriage 10 is still.

The operation of this construction is the same as that of the first form of embodiment and therefore it is not deemed necessary to describe it again.

Of course, the specific forms of embodiment described hereinabove the illustrated in the accompanying drawings should not be construed as limiting the present invention since they are given only by way of illustration and many modifications and variations may be brought thereto without departing from the basic principles of the invention as set forth in the appended claims.

Thus, notably, a plurality of aligned basins, for instance three, may be disposed between the two rails 5 or races 7, thus permitting a continous operation, the sheets of bitumen being cast in succession into each basin, so that they cool down in another basin and are cut in the third one, and the transverse girder 3 may be caused to span at will anyone of these basins, the transfer from one basin to another being greatly facilitated by using hydraulic cylinder and piston jacks permitting of raising the apparatus sufficiently.

What is claimed as new is:

1. Apparatus for cutting cakes of bitumen or other similar products out of a sheet of said product during the cooling thereof in a basin in which it was previously cast, comprising a transverse, substantially horizontal girder spanning said basin, wheels for supporting and guiding either end of said girder on longitudinal races disposed on either side of said basin, means for feeding said girder step by step on said wheels, a carriage suspended from said girder, means for driving said carriage with a continuous motion in a forward direction corresponding to the cutting of a transverse strip of product out of said sheet and for driving said carriage step by step in a return direction corresponding to the removal of said cut strip, a heated cutter suspended from said carriage, means for lowering said cutter to an operative position and enabling same to cut a transverse strip out of said sheet or product when said carriage travels in said forward direction, means for raising and holding said cutter in an inoperative position when said carriage travels in said return direction, a pusher arm carried by said carriage and having one end adapted to slip on the strip of product during the cutting thereof when said carriage travels in said forward direction and to push the end of the freshly cut strip in front of said pusher arm when said carriage travels in said return direction, a wedge member adapted to roll transversely on said basin bottom, means for drivingly coupling said wedge member to said carriage so as to cause said wedge member to raise said strip of product as it is cut out of said sheet, a transverse belt run adapted to support and carry along transversely said transverse strip of product when said strip has been cut completely out of said sheet, means connected to said carriage for unrolling said belt run under said strip, behind said wedge member, as said carriage moves in a forward direction and as said strip is cut out of said sheet while avoiding any relative movement between said strip and said belt run, and a longitudinal cutter adapted to cut a cake of product out of said strip each time said strip is stopped during its step by step travel in said return direction.

2. Apparatus according to claim 1, wherein said belt run is stretched between two moveable stretching rollers and is of a length greater than that of said strip of product to be cut out of the sheet and further comprises a series of parallel, closely spaced belt-forming rollers disposed at spaced intervals between said stretching rollers, the distance between centers of any pair of adjacent belt-forming rollers being small enough to prevent the transverse strip of bitumen from sagging detrimentally in the gaps formed between said adjacent rollers, at least some of said belt-forming rollers being provided with an electromagnetic brake becoming operative when said carriage is stopped to prevent said rollers from rotating.

3. Apparatus according to claim 1, wherein said cutter is pivotally suspended from said carriage by means of a pivot pin mounted on said carriage; said cutter fixedly attached to said pivot pin; a lever rigidly mounted on said pivot pin for concurrent movement therewith and with said cutter; spring means attached at one end thereof to a fixed point on said carriage, said spring means having an oppositely disposed end attached to said lever, whereby said spring means constantly urges said cutter toward said inoperative position; a retractable stop means mounted on said carriage and holding said cutter in an operative position during the cutting operation, said spring means raising said cutter to said inoperative position when said stop is moved to a retracted position.

4. Apparatus according to claim 1, wherein said pusher arm is provided with a shoe, said shoe enabling said arm to slide on the top surface of the product during the cutting thereof and during return of said carriage to engage the vertical end face of said strip cut out of said sheet and propel the same toward said longitudinal cutter.

5. Apparatus according to claim 1, wherein said means for raising and lowering said cutter includes a cutter mounting; means for rotatably mounting said cutter mounting on said carriage; a rotatable lever arm fixedly carried by said rotatably mounting means; a roller follower carried by one end of said rotatable mounting means; cam means disposed in a position to contact said roller follower when said carriage reaches the end of its return direction to direct the cutter to said operative position; a first spring means having one end attached to said carriage and the other to said rotatable lever arm urging the cutter to an inoperative position; second spring means carried by a retractable stop means, said stop means being mounted on said carriage, said second spring means moving said stop means to engage and retain said cutter mounting means and cutter in an operative cutting position when said carriage reaches the end of its movement in the return direction.

6. Apparatus according to claim 1, wherein said means for raising and holding said cutter to an inoperative position comprises a spring attached at one end to said carriage and at the other to a lever arm pivotly connected to said cutter urging said cutter to said inoperative position, a retractable stop member retaining said cutter in its operative position, and cam means engaging a cam follower carried by said top member to retract said stop member when said carriage reaches the end of its movement in the forward cutting direction, thereby permitting the cutter to be elevated to an inoperative position.

7. Apparatus according to claim 1, wherein said wedge member is supported by a moveable trolley removably connected to said carriage; means being provided for automatically disengaging said trolley from said carriage near the end of its movement in the return direction of the carriage, and further means being provided for reengaging said trolley and carriage after said carriage has completed its movement in the return direction.

8. Apparatus according to claim 1, wherein said transverse, substantially horizontal girder spanning said basin is carried at each end by a drive wheel and wherein said drive wheels are rotatably driven simultaneously and in synchronism by a power and reduction unit.

9. Apparatus according to claim 8, wherein said drive wheels comprise metal rims and roll on rails.

10. Apparatus according to claim 1, wherein said traverse girder is carried at one end by a pair of aligned wheels adapted to roll on a longitudinal race running along the same end of said basin and at the other end by a pair of aligned metal-rimmed wheels adapted to roll on a longitudinal rail running along said other end of said basin.

* * * * *